US006336871B1

(12) United States Patent
Ihara et al.

(10) Patent No.: US 6,336,871 B1
(45) Date of Patent: Jan. 8, 2002

(54) SPHERICAL BODY AND METHOD OF MANUFACTURE

(75) Inventors: Keisuke Ihara; Tamotu Kato; Michio Inoue, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/655,412

(22) Filed: Sep. 5, 2000

Related U.S. Application Data

(62) Division of application No. 09/195,434, filed on Nov. 18, 1998, now Pat. No. 6,136,125.

(30) Foreign Application Priority Data

Nov. 18, 1997 (JP) ..... 9-333541

(51) Int. Cl.[7] ..... A63B 37/06; A63B 37/08; A63B 37/04

(52) U.S. Cl. ..... 473/367; 473/371; 473/377; 473/376

(58) Field of Search ..... 473/351, 355, 473/354, 356, 357, 361, 367, 370, 371, 372, 373, 368; 425/503, 504; 156/214, 285; 264/516

(56) References Cited

U.S. PATENT DOCUMENTS

| | | | | |
|---|---|---|---|---|
| 1,387,805 A | | 8/1921 | Roberts | |
| 2,211,028 A | | 8/1940 | Roberts | |
| 3,411,974 A | | 11/1968 | Jones-Hinton et al. | |
| 4,229,401 A | | 10/1980 | Pocklington | |
| 4,943,332 A | | 7/1990 | Sakaguchi et al. | |
| 5,184,664 A | * | 2/1993 | Hayashi et al. | 164/271 |
| 5,342,463 A | | 8/1994 | Addeo et al. | |
| 5,572,804 A | | 11/1996 | Skaja et al. | |
| 5,639,415 A | * | 6/1997 | Kato et al. | 264/532 |
| 6,056,842 A | * | 5/2000 | Dalton et al. | 156/243 |
| 6,132,544 A | * | 10/2000 | Ihara | 156/146 |

* cited by examiner

*Primary Examiner*—Jeanette Chapman
*Assistant Examiner*—Alvin A. Hunter, Jr.
(74) *Attorney, Agent, or Firm*—Sughrue Mion, PLLC

(57) ABSTRACT

A spherical body having a core and a surface layer is manufactured by a method comprising a preforming step in which a pair of sheet blanks (1) are formed into half-shells (11) in a two-part mold (2) having hemispherical concave mold halves by pressing each blank from one side while applying vacuum suction to the other side; a surface layer forming step in which the half-shells are loaded into another two-part mold (12) having pattern-forming projections, the core (19) is placed on one mold half, and the other mold half is joined thereto to close the mold, thereby pressing the core against the inner side of each half-shell, concurrent with which vacuum suction is applied to the outer side; and a molding step in which the surface layer is fused and solidified onto the core within the closed mold.

3 Claims, 2 Drawing Sheets

SPHERICAL BODY AND METHOD OF MANUFACTURE

This is a divisional of application Ser. No. 09/195,434 filed Nov. 18, 1998, now U.S. Pat. No. 6,136,125, the disclosure of which is incorporated herein by reference.

BACKGROUND OF THE INVENTION

1. Field of the Invention

This invention relates to a method of manufacturing a spherical body comprising a core and at least one surface layer enclosing the core. The invention relates also to spherical bodies manufactured by this method, and especially two-piece and multi-piece golf balls.

2. Prior Art

Two-piece golf balls, which have become very popular in recent years, are manufactured by placing a special rubber core as the nest within a two-part mold having upper and lower halves, each with a hemispherical concave inner face, holding the core at the center with pins provided for retraction near the bottom and top of the inner face of the mold, and injection molding a thermoplastic resin such as ionomer resin in the gap between the core and the inner face of the mold.

The manufacture of multi-piece golf balls having two or more surface layers requires the same number of surface layer-forming molds, such as a mold for the inner surface layer and another for the outer surface layer, as there are surface layers. The injection molding process described above is carried out a plurality of times with different molding materials.

However, efforts to form very thin surface layers having a thickness of 1.5 mm or less in the gap between the core serving as the nest and the inner face of the mold using a prior-art injection molding process have met with difficulties. The thermoplastic resin material which has been forced through a runner from the injection molding machine cools and prematurely cures as it is spreads throughout the entire region of the gap, making it likely that unduly thin-walled sections and unfilled areas will arise.

Moreover, the molding of multi-piece balls, which have a multilayer construction, requires that a plurality of molds of differing inner face diameters be furnished and that injection molding be carried out a plurality of times, once for each surface layer. This in turn increases the equipment and labor involved in producing the balls.

SUMMARY OF THE INVENTION

Accordingly, one object of the present invention is to provide a spherical body having at least one very thin surface layer of uniform thickness. Another object of this invention is to provide a method for the manufacture of such spherical bodies which has an excellent productivity efficiency.

The invention achieves these objects by providing a method of manufacturing a spherical body comprising a core and at least one surface layer enclosing the core, the method comprising preforming, surface layer forming and molding steps. In the preforming step which is carried out in a two-part mold having two mold halves, each with a hemispherical concave inner face defining a cavity, a pair of sheet blanks each having opposed sides are placed over the cavities in the two halves of the mold such that one side of each blank faces the inner face of one mold half, then the opposite side of each blank is pressed while vacuum suction is applied to the one side facing the mold inner face, for drawing each sheet blank up against the inner face of the respective mold half, thereby forming a pair of half-shells. In the surface layer forming step which is carried out in another two-part mold having two mold halves, each with an inner face bearing pattern-forming projections, the mold halves are separated, the pair of half-shells having inner and outer sides are loaded into the respective halves of the mold such that the outer side of each half-shell faces the inner face of the corresponding mold half, the core is placed on one of the mold halves, and the other mold half is joined thereto to close the mold, thereby pressing the core against the inner sides of the half-shells, concurrent with which vacuum suction is applied to the outer sides of the half-shells from the respective inner faces of the mold halves. In the molding step, the surface layer is fused and solidified onto the core within the closed mold.

The invention also provides a spherical body which has been manufactured by the inventive method. Any one of the surface layers has a thickness of not more than 1.5 mm.

BRIEF DESCRIPTION OF THE DRAWINGS

The objects, features and advantages of the invention will become more apparent from the following description of an embodiment thereof.

DESCRIPTION OF THE PREFERRED EMBODIMENTS

Figure 1:
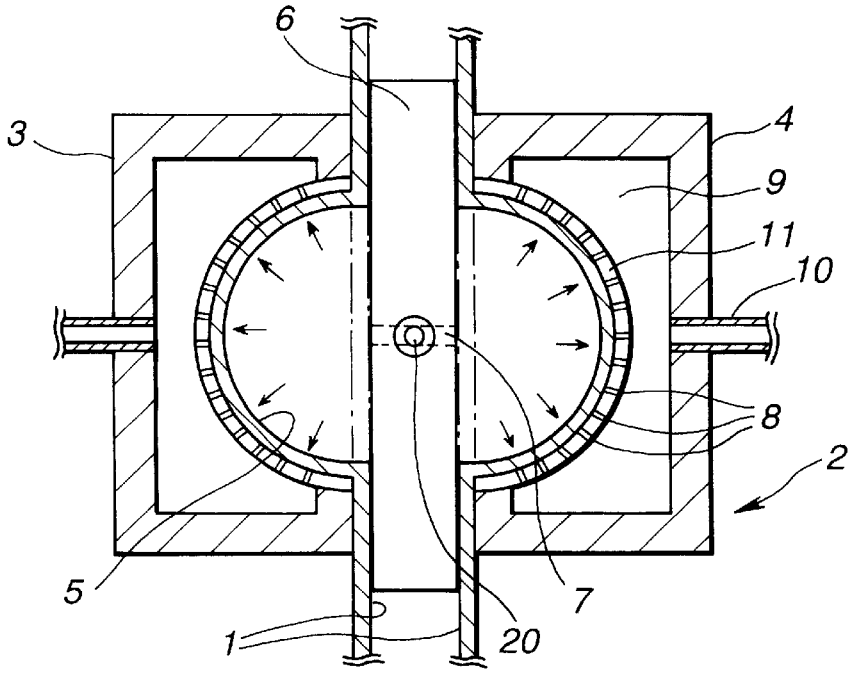
FIG. 1 is a cross-sectional view of a mold used in the preforming step according to one embodiment of the present invention.

In the method of manufacturing a spherical body according to this invention, first a thermoplastic resin used as the surface layer material is rendered into the form of sheets by a known apparatus such as an extruder or rolls.

The sheet-like blanks thus obtained may have a single-layer construction or a multilayer construction composed of two or more layers, the particular construction being selected in accordance with the surface layer to be formed on the spherical body. For example, use may be made of a plurality of sheets of differing thicknesses and materials that have first been stacked together using rolls or the like. The sheet blank which is either a single-layer or multilayer construction is to be preformed into a cup-shaped half-shell. The thickness of the sheet blank is preferably set at 0.1 to 1.85 mm, and especially 0.5 to 1.0 mm. No particular limit is imposed on the thermoplastic resin which is formed into sheets. Suitable examples include ionomer resins as well as other thermoplastic elastomers. Even mixtures of these materials may be used.

In the practice of this invention, first a pair of the above sheet blanks are preformed into cup-shaped half-shells by vacuum forming within a horizontally or laterally separating two-part mold in which each half of the mold has a hemispherical concave inner face. In cases where there are a plurality of surface layers, sheet blanks having a multilayer construction are preformed in a single operation. The outer diameter and shape of the preformed cup-shaped half-shells need not necessarily be made the same as the diameter and shape of the inner face of the mold in the final step. The reason is that the half-shells are stretched and reformed within the final mold, as is described subsequently.

The pair of half-shells that have been formed in the manner described above are then each loaded into a horizontally or laterally separating two-part mold used in the final step, the core is placed within one of the mold halves, generally the bottom half, in which a half-shell has been loaded, following which this mold half is joined with the other mold half. The core presses against the inner sides of the half-shells and vacuum suction is applied at the same time to the space between the half-shells and the mold inner faces, thereby carrying out secondary molding. The moment that the two mold halves have completely joined, the shells arrive at the same shape as the final product. After the two-part mold has been closed, the material is molded by melting and solidification through the conventional application within the mold of heat and pressure followed by cooling.

The core used in the above process may be molded by a conventional technique from a rubber-based or other known material, and may have any suitable diameter.

Carrying out the method of the invention as described above eliminates the need to pass heat-melted material through a narrow gap surrounded by a rapid heat transfer metal, thereby making it possible to easily form around the core a very thin surface layer of uniform thickness.

Moreover, in cases where a plurality of surface layers are formed, it is not necessary to use a plurality of molds having differing mold inner diameters, and so less labor is required. Hence, this method of manufacturing spherical bodies has an excellent production efficiency.

The spherical bodies of this invention are obtained by the above-described manufacturing method and have at least one very thin surface layer with a uniform thickness of not more than 1.5 mm. A thickness greater than 1.5 mm may give rise to the problems that sheet blanks cannot easily be formed using rolls or the like, the above-described vacuum suction operation becomes difficult to carry out, and there is less freedom in the choice of core diameter within the product and less potential for improved performance in the spherical body. The overall thickness of the surface layer or layers is preferably 0.1 to 1.5 mm, and more preferably 0.5 to 1.0 mm.

Therefore, even when the spherical bodies of this invention have a plurality of surface layers, the overall thickness of the surface layers never becomes excessive. Because this allows the diameter of the core to be increased, there is a greater degree of freedom in the design of the spherical body, making it possible to obtain spherical bodies having a higher level of performance.

Figure 2:
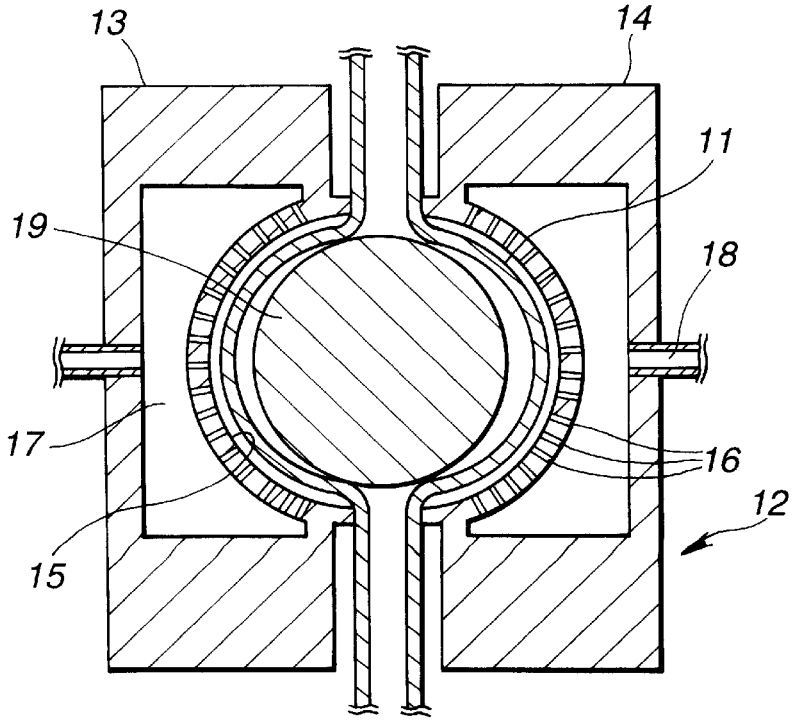
FIG. 2 is a cross-sectional view of a mold used in the surface layer forming and molding steps according to the same embodiment of the invention.
Figure 3:
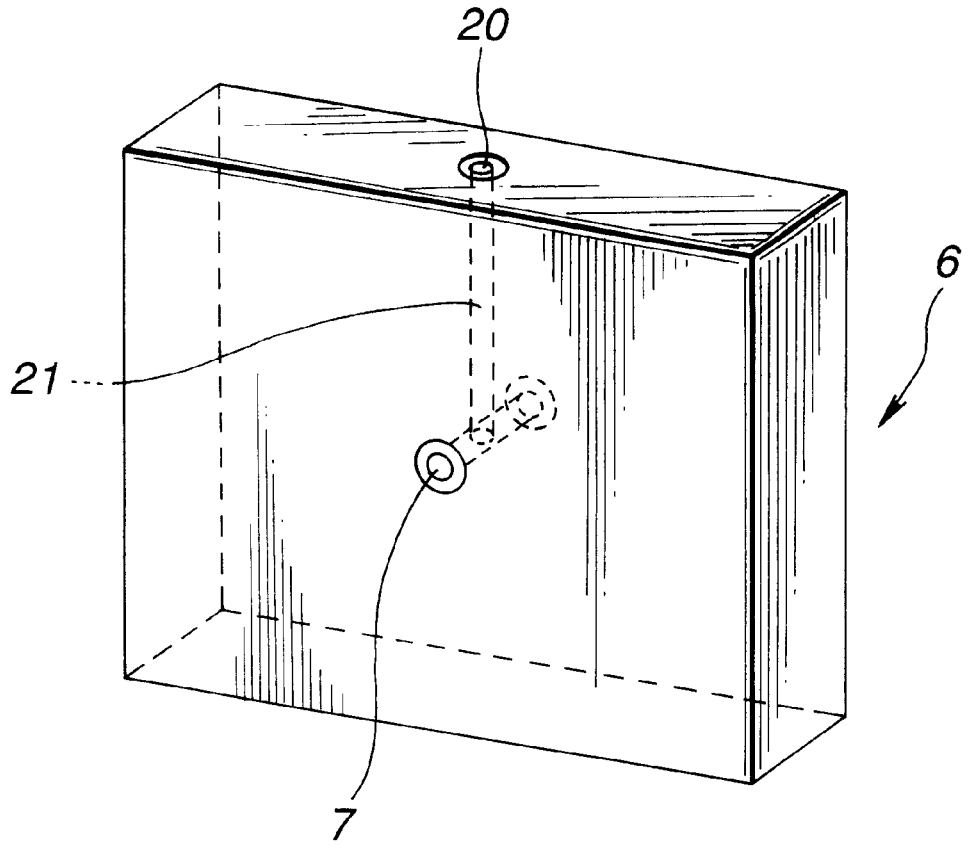
FIG. 3 is a perspective view showing an air blowing device used in the same embodiment.

Referring to FIGS. 1 to 3, one embodiment of the method of the invention is described below in which a solid golf ball is manufactured as a typical spherical ball. The ball manufactured in this embodiment is constructed of a core composed primarily of polybutadiene rubber and one surface layer made of an ionomer resin.

A pair of ionomer resin sheet blanks are each formed to a thickness of 1.85 mm and a suitable predetermined width using a known T-die extruder (not shown). The resulting extruded sheet blanks are delivered by a conveyor or like means (not shown) to a laterally separating two-part preform mold, situated on the downstream side of the extruder, in which the two mold halves are separated.

FIG. 1 is a cross-sectional view of a two-part mold 2 having left and right halves 3 and 4, each with a hemispherical concave inner face 5, that are laterally movable to open and close. In the diagram, the mold is depicted with the mold halves laterally separated. The pair of sheet blanks 1, 1 are delivered and stopped at the positions between the mold halves 3 and 4 as indicated in the diagram by the dotted-and-dashed lines. Thereafter, an air blowing device 6 having opposed nozzles 7 is lowered from above the mold 2 and disposed between the pair of sheet blanks 1,1.

Next, the left and right halves 3,4 of the mold are brought closer to establish a seal between the sheet blanks 1, 1 and the air blowing device 6. Then, air is blown in the direction of the arrows in the diagram at a pressure of 5 kg/cm$^2$ from the nozzles 7 in the air blowing device 6, pushing the sheet blanks 1, 1 against the inner faces 5, 5 of the respective mold halves.

The inner faces 5, 5 of the mold have a plurality of openings 8 of about 0.1 mm in diameter which communicate with chambers 9 in the mold halves 3 and 4 which are, in turn, in communication with air suction/feed means (not shown) through ports 10. As the sheet blanks are pressed against the inner faces 5, 5 of the mold by the air pressure, air between the sheet blanks 1, 1 and the mold inner faces 5, 5 is sucked into the chambers 9 through the openings 8 and then discharged through the ports 10 to the exterior. This draws the sheet blanks 1, 1 up against the mold inner faces 5, 5, thereby preforming the blanks into a pair of cup-shaped half-shells.

When the preforming is completed, the mold 2 is opened, the air blowing device 6 retreats above the mold in FIG. 1, and the reverse of the pressing operation described above is carried out. Namely, air is blown onto the outer surface of the half-shells 11 through the openings 8 in the mold, causing the cup-shaped half-shells 11 to be released from the mold 2. The shells 11 are then carried on to the subsequent final forming step.

FIG. 2 is a cross-sectional diagram showing a two-part mold 12 for molding golf balls which has left and right halves 13 and 14 with hemispherical concave inner faces and which is used in the final forming step. In this diagram, the left and right halves are shown in a laterally opened state.

A large number of projections (not shown) for forming dimples on the surface layer are provided on inner faces 15, 15 of the mold halves 13 and 14, in addition to which a large number of openings 16 having a diameter of about 0.1 mm are substantially uniformly distributed between these projections and over the entire region of the inner faces.

The openings 16 communicate with chambers 17 in the mold halves 13 and 14, which are, in turn, in communication with air suction/feed means (not shown) through to ports 18. Any air at the mold inner faces can be vacuum suctioned by applying a suction force of at least about −500 mmHg from the ports 18.

As shown in FIG. 2, the pair of cup-shaped half-shells 11, 11 are delivered from the preforming step and loaded into the left and right mold halves 13, 14, respectively, and a spherical core 19 is placed in one of the half-shells on the mold. As the left and right mold halves 13, 14 are gradually closed, the core 19 presses the half-shells 11, 11 against the mold inner faces 15, 15. At the same time, a suction force is applied to the mold inner faces 15, 15, whereby the air between the half-shells 11, 11 and the mold inner faces 15, 15 is vacuum suctioned into the chambers 17 and discharged through the ports 18, thereby drawing the half-shells 11, 11 up against the mold inner faces 15, 15. When the left and right halves 13, 14 are completely joined to close the mold, the half-shells are brought in close contact with the mold halves by the outward pressing of the core and the pneumatic suction to the mold inner faces. Then vacuum suction is stopped, a pressure of 5 kg/cm$^2$ is applied from the ports 18, and the mold is heated to a predetermined temperature by a heater (not shown) in contact with the mold sidewall and then cooled. The core 19 and shell 11 are accordingly fused and solidified, thereby producing a golf ball.

After the final forming step is completed, the ball is removed from the mold, burrs remaining on the ball periphery due to mold removal are dislodged by punching or some other means, and the surface is finished with a buff grinder to give the final product.

The resulting golf ball has a surface layer which is very thin, the thickness being not more than 1.5 mm (in this embodiment, about 1.44 mm), and which has been formed to a uniform thickness relative to the surface of the core. Accordingly, sufficient enlargement of the core diameter is possible when structurally modifying the ball. This, in combination with the uniform thickness of the surface layer, makes it possible to achieve a high level of ball performance.

In the embodiment described above, the air blowing device 6 used in preforming the half-shells is a generally rectangular box made of metal which has an air inlet 20 at the top, the nozzles 7 on opposed sides, and a channel 21 at the interior in communication with the inlet 20 and nozzles 7 as shown in FIG. 3.

As noted above, the mold inner face in the final forming step is provided with openings, although an acceptable alternative is to have the inner face portion of the mold composed of a porous metal material for vacuum suction of air through the microscopic pores in the material.

In the preforming step described above, pressing of the sheet blanks 1, 1 is carried out by air pressure. However, the same effect may also be achieved with a die mechanism that uses a core such as a metal sphere. Although the air blowing device 6 has been described above as a metal box, a rubber bladder may also be used. The rubber bladder can play the role of a core by delivering and discharging air to and from the interior of the bladder.

In the foregoing embodiment, during the period from the formation of sheet blanks for the surface layer up to the finishing operation in which the ball is deburred by punching after the final forming of the shell, if the sheet blanks are delivered continuously between the steps without cutting or separation of extra portions, tools such as dollies and carts for transporting intermediate product and space for storing the intermediate product become unnecessary, enabling the process to be simplified.

In the above embodiment, different molds were used in preforming and final forming, but both steps may be carried out using only the mold employed in final forming. In the final forming step described above, there may be added an operation that increases the closeness of contact between the core and the half-shells by vacuum suctioning between the core and the inner side of the half-shells.

The manufacturing method of the present invention enables the reliable formation of a surface layer of uniform thickness. It is readily adaptable to the production of spherical bodies having thinner surface layers or a plurality of surface layers, and avoids reduction in the core diameter. It thereby offers the potential for further improvement in the performance of spherical bodies through development efforts on the spherical body itself. This method having superior moldability can thus be used to easily and efficiently mass-produce spherical bodies such as golf balls having a thin surface layer of excellent molding properties and uniform thickness.

Although a preferred embodiment has been described, many modifications and variations may be made thereto in light of the above teachings. It is therefore to be understood that the invention may be practiced otherwise than as specifically described without departing from the scope of the appended claims.

What is claimed is:

1. A spherical body comprising: a core and at least one surface layer enclosing the core, said at least one surface layer having a thickness not greater than 1.5 mm;

said spherical body formed by performing carried out in a two-part mold having two mold halves, each mold with half a hemispherical concave inner face defining a cavity, wherein a pair of sheet blanks each having opposed sides are placed over the cavities in the two halves of the mold such that one side of each blank faces the inner face of one mold half, then the opposite side of each blank is pressed while vacuum suction is applied to the one side facing the mold inner face through a large number of holes distributed uniformly on said inner face, for drawing each sheet blank up against the inner face of the respective mold half, thereby forming a pair of half-shells wherein the holes of the mold inner face are approximately 0.1 mm in diameter, respectively;

said at least one surface layer formed in another two-part mold having two mold halves, each of said mold halves of said another two-part mold having an inner face bearing pattern-forming projections, the pair of half-shells having inner and outer sides are loaded into the respective halves of the mold such that the outer side of each half-shell faces the inner face of the corresponding mold half, said core placed on one of the mold halves, and the other mold half is joined thereto to close the mold, thereby pressing the core against the inner sides of the half-shells, concurrent with which vacuum suction is applied to the outer sides of the half-shells from the respective inner faces of the mold halves which have a large number of openings; and molding in which the surface layer is fused and solidified onto the core within the closed mold.

2. A spherical body of claim 1, wherein the inner face portion of the mold is composed of a porous metal material.

3. A spherical body of claim 1, wherein air is blown by an air blowing device so that the opposite side of each blank is pressed in said preforming step.

* * * * *